US009709908B2

(12) United States Patent
Tanaka et al.

(10) Patent No.: US 9,709,908 B2
(45) Date of Patent: Jul. 18, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Daisuke Tanaka, Yokohama (JP); Kazumichi Sugiyama, Numazu (JP); Takeshi Murakami, Numazu (JP); Daisuke Kawaguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/016,100

(22) Filed: Feb. 4, 2016

(65) Prior Publication Data

US 2016/0231659 A1 Aug. 11, 2016

(30) Foreign Application Priority Data

Feb. 9, 2015 (JP) ..... 2015-023705

(51) Int. Cl.
*G03G 5/14* (2006.01)

(52) U.S. Cl.
CPC ..... *G03G 5/144* (2013.01)

(58) Field of Classification Search
CPC ..... G03G 5/142; G03G 5/144; G03G 5/14
USPC ..... 430/65, 63, 60
See application file for complete search history.

(56) References Cited

U.S. PATENT DOCUMENTS

2015/0241803 A1* 8/2015 Ikari ..... G03G 5/14 430/56

FOREIGN PATENT DOCUMENTS

| | | | |
|---|---|---|---|
| JP | 2008-26482 | A | 2/2008 |
| JP | 2011-53592 | A | 3/2011 |
| JP | 2013-137526 | A | 7/2013 |
| JP | 2014-160224 | A | 9/2014 |

OTHER PUBLICATIONS

Diamond, A.S., ed., Handbook of Imaging Materials, Marcel Dekker, Inc., NY (1991), pp. 395-396.*
Japanese Patent Office J-Plat-Pat machine-assisted English-language translation of Japanese Patent 2008-026482 A (pub. Feb. 2008).*

* cited by examiner

*Primary Examiner* — Janis L Dote
(74) *Attorney, Agent, or Firm* — Canon U.S.A. Inc., IP Division

(57) ABSTRACT

An electrophotographic photosensitive member includes an undercoat layer, the undercoat layer having a volume resistivity of from $1\times10^{10}$ Ω·cm to $1\times10^{13}$ Ω·cm, the undercoat layer contains (A) a zinc oxide particle and (B) at least one particle selected from titanium oxide particles coated with tin oxide doped with any one of zinc, aluminum, fluorine, tungsten, niobium, tantalum, and phosphorus and a titanium oxide particle coated with oxygen deficient tin oxide, and the content of the particle (B) in the undercoat layer is from 3% by mass to 20% by mass based on the content of the particle (A).

9 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including an electrophotographic photosensitive member.

Description of the Related Art

Electrophotographic photosensitive members each including an undercoat layer and a photosensitive layer which are formed in this order on a support are used as electrophotographic photosensitive members for electrophotographic apparatuses.

There is a technique of incorporating metal oxide particles in an undercoat layer for the purpose of suppressing storage of charge (for example, electrons) in the undercoat layer. Among metal oxide particles, zinc oxide particles can be preferably used as the metal oxide particles in the undercoat layer in view of electric characteristics such as volume resistivity and dielectric constant. Japanese Unexamined Patent Application Publication No. 2013-137526 describes a technique of incorporating zinc oxide particles in an undercoat layer.

SUMMARY OF THE INVENTION

However, when zinc oxide particles are used in an undercoat layer, there is the problem of easily causing ghost and a change in light-area potential due to the high powder resistance of zinc oxide particles. A conceivable solution of the problem is to increase the content of zinc oxide particles, but this has the problem of the occurrence of cracks. Also, zinc oxide particles have the problem that lines and flaws of a support are seen through the particles due to the high transparency thereof. It is known that titanium oxide particles are contained for concealing the lines and flaws of a support, but the storage of charge easily occurs due to the high powder resistance of titanium oxide particles, thereby easily increasing a change in light-area potential. Further, charge little flows into the titanium oxide particles, and thus an excessive current easily locally flows into the zinc oxide particles, thereby easily causing black dots.

An object of the present invention is to provide an electrophotographic photosensitive member capable of satisfactorily suppressing both a change in light-area potential and black dots and concealing defects of a support when an undercoat layer contains zinc oxide particles. Another object of the present invention is to provide a process cartridge and an electrophotographic apparatus each including the electrophotographic photosensitive member.

The present invention relates to an electrophotographic photosensitive member including a support, an undercoat layer on the support, and a photosensitive layer on the undercoat layer.

The undercoat layer has a volume resistivity of from $1\times10^{10}$ Ω·cm to $1\times10^{13}$ Ω·cm.

The undercoat layer contains (A) a zinc oxide particle and (B) at least one particle selected from titanium oxide particles coated with tin oxide doped with any one of zinc, aluminum, fluorine, tungsten, niobium, tantalum, and phosphorus, and a titanium oxide particle coated with oxygen-deficient tin oxide.

The content of the particle (B) in the undercoat layer is from 3% by mass to 20% by mass based on the content of the particle (A).

Also, the present invention relates to a process cartridge including the electrophotographic photosensitive member and at least one selected from the group consisting of a charging unit, a development unit, a transfer unit, and a cleaning unit, the electrophotographic photosensitive member and the at least one unit being integrally supported. The process cartridge is detachable from an electrophotographic apparatus body.

Further, the present invention relates to an electrophotographic apparatus including the electrophotographic photosensitive member, a charging unit, an exposure unit, a development unit, and a transfer unit.

The present invention can provide an electrophotographic photosensitive member capable of satisfactorily suppressing both a change in light-area potential and a black dot and concealing defects of a support when an undercoat layer contains zinc oxide particles. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

An electrophotographic photosensitive member of the present invention includes a support, an undercoat layer on the support, and a photosensitive layer on the undercoat layer. Examples of the photosensitive layer include a single-layer photosensitive layer having a single layer containing a charge generation material and a charge transport material, and a laminated-type photosensitive layer including a stack of a charge generation layer containing a charge generation material and a charge transport layer containing a charge transport material. The stack-type photosensitive layer is preferred.

Figure 2A:
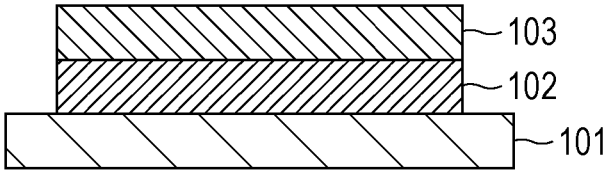
FIGS. 2A and 2B are drawing each illustrating an example of a layer configuration of an electrophotographic photosensitive member.
Figure 2B:
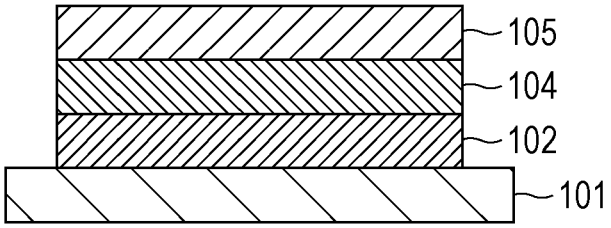

FIGS. 2A and 2B each show an example of a layer configuration of the electrophotographic photosensitive member of the present invention. FIG. 2A shows a single-layer photosensitive layer, and in this type, an undercoat layer 102 is provided on a support 101, and a photosensitive layer 103 is provided on the undercoat layer 102. FIG. 2B shows a laminated-type photosensitive layer, and in this type, an undercoat layer 102 is provided on a support 101, a charge generation layer 104 is provided on the undercoat layer 102, and a charge transport layer 105 is provided on the charge generation layer 104.

The undercoat layer of the present invention has the following characteristics. The undercoat layer has a volume resistivity of from $1\times10^{10}$ Ω·cm to $1\times10^{13}$ Ω·cm. The undercoat layer contains (A) a zinc oxide particle and (B) at least one particle selected from the group consisting of titanium oxide particles coated with tin oxide doped with any one of zinc, aluminum, fluorine, tungsten, niobium, tantalum, and phosphorus, and a titanium oxide particle coated with oxygen-deficient tin oxide. The content of the particle (B) in the undercoat layer is from 3% by mass to 20% by mass based on the content of the particle (A).

The inventors suppose the reason why the electrophotographic photosensitive member having the characteristics described above is capable of satisfactorily suppressing both a change in light-area potential and a black dot and concealing defects of the support as follows.

It is considered that by using titanium oxide particles coated with tin oxide, local injection of excessive charge into zinc oxide particles is suppressed and a black dot is suppressed. It is also considered that coating titanium oxide with tin oxide improves conductivity, and the effect of improving a charge flow from an interface of the photosensitive layer suppresses a change in light-area potential. In addition, tin oxide of the titanium oxide particles is doped with any one of zinc, aluminum, fluorine, tungsten, niobium, tantalum, and phosphorus, or the tin oxide is characteristic of being oxygen-deficient tin oxide. Therefore, local injection of excessive charge into the zinc oxide particles is further suppressed.

The undercoat layer has a volume resistivity of from $1\times10^{10}$ Ω·cm to $1\times10^{13}$ Ω·cm. When the undercoat layer has a volume resistivity of less than $1\times10^{10}$ Ω·cm, an amount of current flowing in the undercoat layer is increased. In particular, when the charge generation layer is formed on the undercoat layer, charge injection easily takes place, and a black dot easily occurs. On the other hand, when the undercoat layer has a volume resistivity of more than $1\times10^{13}$ Ω·cm, charge little flows in the undercoat layer, and thus charge storage easily occurs in the interface of the undercoat layer, thereby easily increasing a change in light-area potential.

In the present invention, the content of the particle (B) in the undercoat layer is from 3% by mass to 20% by mass based on the content of the particle (A). When the content of the particle (B) is less than 3% by mass, the effect of concealing defects of the support cannot be easily controlled. On the other hand, when the content of the particle (B) exceeds 20% by mass, charge preferentially flows in the particle (B) of the undercoat layer, and block dots easily locally occur.

Figure 3:
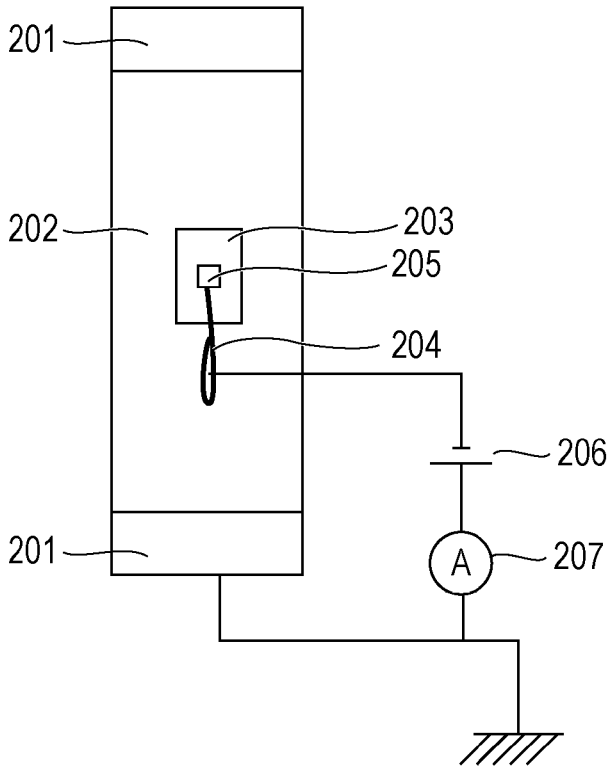
FIG. 3 is a drawing (top view) illustrating a method for measuring the volume resistivity of an undercoat layer.
Figure 4:
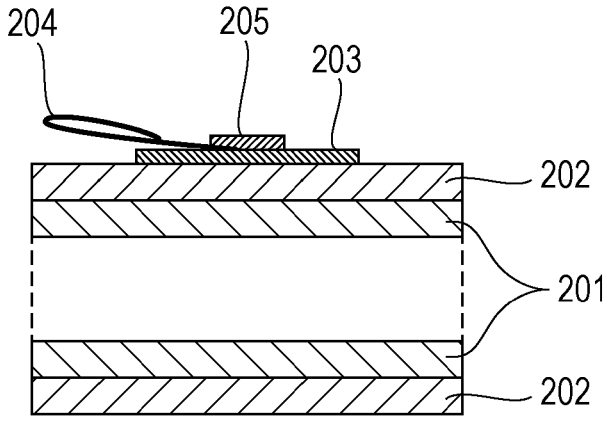
FIG. 4 is a drawing (cross-sectional view) illustrating a method for measuring the volume resistivity of an undercoat layer.

A method for measuring the volume resistivity of the undercoat layer is described by using FIGS. 3 and 4. FIG. 3 is a top view illustrating the method for measuring the volume resistivity of the undercoat layer. FIG. 4 is a cross-sectional view illustrating the method for measuring the volume resistivity of the undercoat layer.

The volume resistivity of the undercoat layer is measured in an environment at room temperature and normal humidity (23° C./50% RH). A copper tape 203 (manufactured by Sumitomo 3M Ltd., model No. 1181) is applied to a surface of the undercoat layer 202 and is used as a surface-side electrode of the undercoat layer 202. Also, the support 201 is used as a back-side electrode of the undercoat layer 202. In addition, a power supply 206 for applying a voltage between the copper tape 203 and the support 201, and a current measuring device 207 for measuring a current flowing between the copper tape 203 and the support 201 are installed. Also, a copper wire 204 is placed on the copper tape 203 in order to apply a voltage to the copper tape 203. Further, the same copper tape 205 as the copper tape 203 is applied on the copper wire 204 so that the copper wire 204 does not protrude from the copper tape 203, and the copper wire 204 is fixed to the copper tape 203. A voltage is applied to the copper tape 203 by using the copper wire 204.

A value represented by an equation (1) below is used as the volume resistivity ρ (Ω·cm) of the undercoat layer 202.

$$\rho=1/(I-I_0)\times S/d(\Omega\cdot\text{cm}) \quad (1)$$

In the equation, $I_0$ represents a background current value (A) when a voltage is not applied between the copper tape 203 and the support 201, I represents a current value (A) when a voltage of 1 V containing only a DC component is applied, d represents the thickness (cm) of the undercoat layer 202, and S represents the area ($cm^2$) of the surface-side electrode (copper tape 203) of the undercoat layer 202.

In the measurement, since a micro-current amount of $1\times10^{-6}$ A or less is measured, a device capable of measuring a micro-current is preferably used as the current measuring device 207. An example of such a device is pA meter (trade name: 4140B) manufactured by Yokogawa Hewlett-Packard Company.

The measurement of the volume resistivity of the undercoat layer shows the same value in a state in which only the undercoat layer is formed on the support and in a state in which the layers (the photosensitive layer etc.) on the undercoat layer are separated from the electrophotographic photosensitive member, leaving only the undercoat layer on the support.

In order to bring the volume resistivity of the undercoat layer in the range described above, the particle (B) having a powder resistivity of from $1.0\times10^{2}$ Ω·cm to $1\times10^{10}$ Ω·cm is preferably used. The power resistivity is more preferably from $1.0\times10^{2}$ Ω·cm to $1\times10^{8}$ Ω·cm and still more preferably from $1.0\times10^{5}$ Ω·cm to $1\times10^{8}$ Ω·cm. When the article (B) has a power resistivity within the range described above, the volume resistivity of the undercoat layer can be easily controlled within the range, and chargeability of the electrophotographic photosensitive member can be easily maintained.

The particle (B) is more preferably a titanium oxide particle coated with tin oxide doped with aluminum, a titanium oxide particle coated with tin oxide doped with zinc, or a titanium oxide particle coated with oxygen-deficient tin oxide. These particles further suppress the local injection of excessive charge into the zinc oxide particle, thereby exhibiting excellent suppression of black dots.

The ratio (coverage) of tin oxide ($SnO_2$) in the particle (B) is preferably from 10% to 60% by mass and more preferably from 15% to 55% by mass based on the total of the particle (B). In order to control the coverage of tin oxide, a tin raw material necessary for forming tin oxide is preferably mixed when the particle (B) is produced. For example, an amount of tin chloride ($SnCl_4$) added is determined in consideration of the coverage of tin oxide formed from the tin chloride used as the tin raw material. In the present invention, the mass of zinc, aluminum, fluorine, tungsten, niobium, tantalum, or phosphorus which is doped into tin oxide is not taken into consideration in the coverage of tin oxide. When the coverage of tin oxide is 10% to 60% by mass, the particle (B) is easily uniformly coated.

Description is made of a case in which the particle (B) is a titanium oxide particle coated with tin oxide doped with any one of zinc, aluminum, fluorine, tungsten, niobium, tantalum, and phosphorus. An amount (doping amount) of zinc, aluminum, fluorine, tungsten, niobium, tantalum, or phosphorus doped into tin oxide is preferably from 0.1% by mass to 10% by mass based on tin oxide in the particle (B). With the doping amount within this range, black dots can be suppressed, and the powder resistivity of the particle (B) can be easily controlled in the range of from $1.0\times10^2$ Ω·cm to $1\times10^8$ Ω·cm.

The powder resistivity of the particle (B) is measured in an environment at room temperature and normal humidity (23° C./50% RH) as follows. In the present invention, a resistance measuring device (trade name, Loresta GP) manufactured by Mitsubishi chemical Co., Ltd. is used as a measuring device. A pellet-shaped measurement sample is formed by fixing, under a pressure of 500 kg/cm$^2$, the powder (B) to be measured. The applied ovulate is 100 V.

The powder resistivity of the particle (B) can be controlled by the coverage, firing time, or firing temperature of tin oxide.

When the powder resistivity of the particle (B) is from $1.0\times10^2$ Ω·cm to $1\times10^5$ Ω·cm, the suppression of black dots and a change in light-area potential is more excellent.

The average primary particle diameter of the particle (B) is preferably from 100 nm to 500 nm from the viewpoint that a ratio between the flaw concealing property of the support due to light transmission and the amount of conductive powder can be easily controlled.

The zinc oxide particle may be a particle treated with a surface treatment agent such as a silane coupling agent or the like for suppressing black dots due to the charge injection into the photosensitive layer side from the support.

Examples of the silane coupling agent include N-2-(aminoethyl)-3-aminopropylmethyl dimethoxysilane, 3-aminopropylmethyl diethoxysilane, (phenylaminomethyl) methyl dimethoxysilane, N-2-(aminoethyl)-3-aminoisobutylmethyl dimethoxysilane, N-ethylaminoisobutylmethyl diethoxysilane, N-methylaminopropylmethyl dimethoxysilane, vinyltrimethoxysilane, 3-aminopropyl triethoxysilane, N-(2-aminoethyl)-3-aminopropyl trimethoxysilane, methyltrimethoxysilane, 3-glycidoxypropyl trimethoxysilane, 3-methacryloxypropyl trimethoxysilane, 3-chloropropyl trimethoxysilane, 3-mercaptopropyl trimethoxysilane, and the like.

The average primary particle diameter of the zinc oxide particle is not particularly limited as long as electrophotographic characteristics can be obtained, but is preferably from 10 nm to 200 nm and more preferably from 20 nm to 150 nm from the viewpoint of conductivity.

The average primary particle diameter of the tin oxide-coated particle (particle (B)) is not particularly limited as long as the defect concealing property of the support and electrophotographic characteristics can be obtained, but is preferably from 50 nm to 300 nm and more preferably from 100 nm to 200 nm.

The undercoat layer preferably contains a binder resin. Example of the binder resin include acrylic resins, allyl resins, alkyd resins, ethylcellulose resins, ethylene-acrylic acid copolymers, epoxy resins, casein resins, silicone resins, gelatin resins, phenol resins, urethane resins, butyral resins, melamine resins, polyacrylate, polyacetal, polyamide-imide, polyamide, polyallyl ether, polyimide, polyester, polyethylene, polycarbonate, polystyrene, polysulfone, polyvinyl alcohol, polybutadiene, polypropylene, and the like.

Among these, a curable resin is preferred from the viewpoint of suppressing the environmental dependence of a change in potential. Examples of the curable resin include phenol resins, urethane resins, epoxy resins, acrylic resins, and melamine resins.

A urethane resin is composed of a cured product of an isocyanate compound and a polyol resin.

Examples of the isocyanate compound include 2,4-tolylene diisocyanate, 2,6-tolylene diisocyanate, diphenylmethane-4,4'-diisocyanate, 1-isocyanato-3,3,5-trimethyl-5-isocyanatomethylcyclohexane (isophorone diisocyanate, IPDI), hexamethylene diisocyanate (HDI), HDI-trimethylolpropane adduct, HDI-isocyanurate, and HDI-biuret.

Among these isocyanate compounds, from the viewpoint of easily increasing a crosslink density and suppressing adsorption of water, aliphatic diisocyanates such as hexamethylene diisocyanate, isophorone diisocyanate, and the like are particularly preferred.

From the viewpoint of solution stability of a coating solution for an undercoat layer, the isocyanate is preferably a blocked isocyanate blocked with a blocking agent. Examples of the blocking agent include oxime-based compounds such as formaldehyde oxime, acetoaldoxime, methyl ethyl ketoxime, cyclohexanone oxime, acetone oxime, methyl isobutyl ketoxime, and the like; active methylene-based compounds such as Meldrum's acid, dimethyl malonate, diethyl malonate, di-n-butyl malonate, ethyl acetate, acetylacetone, and the like; amine-based compounds such as diisopropylamine, diphenylaniline, aniline, carbazole, and the like; imine-based compounds such as ethylene imine, polyethylene imine, and the like; acid imide-based compounds such as succinic acid imide, maleic acid imide, and the like; imidazole-based compounds such as malonate, imidazole, benzimidazole, 2-methylimidazole, and the like; triazole-based compounds such as 1,2,3-triazole, 1,2,4-triazole, 4-amino-1,2,4-triazole, benzotriazole, and the like; acid amide-based compounds such as acetanilide, N-methylacetamide, acetic acid amide, and the like; lactame-based compounds such as ε-caprolactame, ε-valerolactame, γ-butyrolactame, and the like; urea-based compounds such as urea, thiourea, ethylene urea, and the like; sulfites such as sodium bisulfite, and the lie; mercaptane-based compounds such as butylmercaptane, dodecylmercaptane, and the like; phenol-based compounds such as phenol, cresol, and the like; pyrazole-based compounds such as pyrazole, 3,5-dimethylpyrazole, 3-methylpyrazole, and the like; alcohol-based compounds such as methanol, ethanol, 2-propanol, n-butanol, and the like; and combinations of two or more of these blocking agents.

Examples of the polyol resin include polyvinylacetal, polyphenol, polyethylenediol, polycarbonatediol, polyether polyol, polyacryl polyol, and the like. In the present invention, polyvinylacetal is particularly preferred.

The undercoat layer may contain an organic acid metal, and examples thereof include organic acid bismuth, organic acid zinc, organic acid cobalt, and organic acid iron.

Specifically, bismuth octylate, zinc octylate, cobalt octylate, iron octylate, bismuth naphthenate, zinc naphthenate, cobalt naphthenate, and iron naphthenate are preferred. Bismuth octylate, zinc octylate, cobalt octylate, and iron octylate are more preferred, and bismuth octylate and zinc octylate are particularly preferred.

The content ratio (metal oxide particle:resin) of the metal oxide particles (total of the zinc oxide particle (B) and the metal oxide particle) to the binder resin in the undercoat layer is preferably 1:1 to 4:1 (ratio by mass). When the ratio by mass is 1:1 to 4:1, a change in light-area potential during repeated use is satisfactorily suppressed, and the occurrence of cracks in the undercoat layer is further satisfactorily suppressed.

The content ratio (organic acid metal:metal oxide particle) of the organic acid metal (organic acid bismuth, organic acid zinc, organic acid cobalt, or organic acid iron) to the metal oxide particle is preferably 1:200 to 2:10 (ratio by mass). When the ratio by mass is 1:200 to 2:10, a change in light-area potential during repeated use is satisfactorily suppressed, and a difference between a change in light-area potential in an environment of room temperature and normal humidity and a change in light-area potential at high temperature and high humidity is satisfactorily suppressed during repeated use.

[Support]

The support preferably has conductivity (conductive support) and is, for example, a support made of a metal or alloy such as aluminum, stainless steel, copper, nickel, zinc, or the like, or an alloy. When the support made of aluminum or an aluminum alloy is used, an ED pipe, an EI pipe, or such a pipe subjected to cutting, electrolytic composite polishing, or wet or dry honing treatment can be used.

Also, a metal support or a resin support on which a thin film of a conductive material, such as aluminum, an aluminum alloy, an indium oxide-tin oxide alloy, or the like, is formed can be used as the support.

In addition, for the purpose of suppressing interference fringes due to scattering of a laser beam, the surface of the support may be subjected to cutting treatment, roughening treatment, alumite treatment, or the like.

For the purpose of suppressing interference fringes due to scattering of a laser beam and of concealing flaws on the support, a conductive layer may be provided between the support and the undercoat layer.

The conductive layer can be formed by applying a coating solution for a conductive layer, the coating solution being prepared by dispersing conductive particles such as carbon black, metal particles, metal oxide particles, or the like, a binder resin, and a solvent, to form a film and then heat-drying the film.

Examples of the binder resin which can be used for the conductive layer include polyester resins, polycarbonate resins, polyvinyl butyral resins, acryl resins, silicone resins, epoxy resins, melamine resins, urethane resins, phenol resins, alkyd resins, and the like.

Examples of the solvent in the coating solution for a conductive layer include ether solvents, alcohol solvents, ketone solvents, aromatic hydrocarbon solvents, and the like. The thickness of the conductive layer is preferably from 5 μm to 40 μm and more preferably from 10 μm to 30 μm.

The undercoat layer is provided between the support or the conductive layer and the photosensitive layer (the charge generation layer and the charge transport layer).

The undercoat layer can be formed by forming a film of a coating solution for an undercoat layer prepared by mixing and dispersing the zinc oxide particle, the particle (B), the binder resin, and a solvent, and then drying the film.

A dispersion method is, for example, a method using a homogenizer, an ultrasonic disperser, a ball mill, a sand mill, a roll mill, a vibrating mill, an attritor, a liquid collision-type high-speed disperser, or the like.

The solvent used in the coating solution for an undercoat layer can be arbitrarily selected from, for example, alcohol solvents, ketone solvents, ether solvents, ester solvents, halogenated hydrocarbon solvents, aromatic solvents and the like. Examples which can be properly used include methylal, tetrahydrofuran, methanol, ethanol, isopropyl alcohol, butyl alcohol, methyl cellosolve, methoxy propanol, acetone, methyl ethyl ketone, cyclohexanone, methyl acetate, ethyl acetate, dioxane, and the like.

These solvents used in the coating solution for an undercoat layer can be used alone or as a mixture of two or more.

In addition, for the purpose of adjusting the surface roughness of the undercoat layer and decreasing the occurrence of cracking in the undercoat layer, the undercoat layer may further contain organic resin particles or a leveling agent. Examples of the organic resin particles include hydrophobic organic resin particles such as silicone particles, and the like, and hydrophilic organic resin particles such as cross-linked polymethacrylate (PMMA) particles, and the like.

Further, the undercoat layer may contain additives for improving electric characteristics, improving film shape stability, and improving image quality.

Examples of the additives which can be contained include known materials such as conductive materials such as metals, for example, aluminum powder, copper powder, and the like, carbon black, and the like;

electron transport materials such as quinone compounds, fluorenone compounds, oxadiazole compounds, diphenoquinone compounds, alizalin compounds, benzophenone compounds, and the like;

electron transport pigments such as polycyclic condensed compounds, azo compounds, and the like; organic metal compounds such as metal chelate compounds, and silane coupling agents, and the like.

The drying temperature of the undercoat layer is preferably from 100° C. to 190° C. from the viewpoint of suppressing cracking of the undercoat layer and from the viewpoint of strength of the resin film of the undercoat layer. When a urethane resin is used, the drying temperature of the undercoat layer is preferably from 130° C. to 170° C. from the viewpoint of suppressing cracking and from the viewpoint of curability. Also, the drying time is preferably from 10 minutes to 120 minutes.

The thickness of the undercoat layer is preferably from 0.5 μm to 40 μm. When the conductive layer is not provided, from the viewpoint of coverage, the thickness of the undercoat layer is preferably from 10 μm to 40 μm and more preferably from 15 μm to 35 μm. When the conductive layer is provided, the thickness of the undercoat layer is preferably from 0.5 μm to 10 μm.

In order to inhibit charge injection into the photosensitive layer from the undercoat layer, an intermediate layer may be provided between the undercoat layer and the photosensitive layer for the purpose of imparting an electric barrier property.

The intermediate layer can be formed by applying a coating solution for an intermediate layer containing a resin (binder resin) to the undercoat layer to form a film, and then drying the film.

Examples of the resin (binder resin) which can be used for the intermediate layer include polyvinyl alcohol, polyvinyl methyl ether, polyacrylic acids, methylcellulose, ethylcellulose, polyglutamic acid, polyamide, polyimide, polyamide-imide, polyamide acid, melamine resins, epoxy resins, polyurethane, polyglutamic acid esters, and the like.

The thickness of the intermediate layer is preferably from 0.1 μm to 2 μm.

Also, the intermediate layer may contain a polymer of a composition containing an electron transport material having a reactive functional group (polymerizable functional group) for improving a charge flow into the support from the photosensitive layer. This can suppress the elution of a material of the intermediate layer into the solvent of the coating solution for a photosensitive layer when the photosensitive layer is formed on the intermediate layer.

Examples of the electron transport material include quinone compounds, imide compounds, benzimidazole compounds, cyclopentadienylidene compounds, and the like.

Examples of the reactive functional group include a hydroxyl group, a thiol group, an amino group, a carboxyl group, a methoxy group, and the like.

The content of the electron transport material having a reactive functional group of the composition in the intermediate layer is preferably from 30% by mass to 70% by mass. The composition may further contain a cross-linking agent having a group reactive with the electron transport material having a reactive functional group, or a thermoplastic resin having a polymerizable functional group. Examples of the cross-linking agent having a reactive group include isocyanate compounds and the like.

The photosensitive layer (the charge generation layer and the charge transport layer) is provided on the undercoat layer or the intermediate layer.

The charge generation layer can be formed by applying a coating solution for a charge generation layer prepared by dispersing a charge generation material, a binder resin, and a solvent to form a film, and then drying the film. The charge generation layer may include a vapor deposited film of the charge generation material.

Examples of the charge generation material used in the charge generation layer include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinoneimine dyes, styryl dyes, and the like.

These charge generation materials may be used alone or in combination of two or more. Among these, oxytitanium phthalocyanine, chlorogallium phthalocyanine, and hydroxygallium phthalocyanine are preferred from the viewpoint of sensitivity.

Further, the hydroxygallium phthalocyanine is preferably a hydroxygallium phthalocyanine crystal having a crystal form having peaks at Bragg angles $2\theta$ of $7.4°\pm0.3°$ and $28.2°\pm0.3°$ in CuK$\alpha$ characteristic X-ray diffraction.

In the case of a laminated-type photosensitive layer, examples of the binder resin used in the charge generation layer include polycarbonate resins, polyester resins, butyral resins, polyvinyl acetal resins, acrylic resins, vinyl acetate resins, urea resins, and the like. Among these, butyral resins are preferred. These binder resins may be used alone or in combination as a mixture or a copolymer of two or more.

Examples of the solvent used in the coating solution for a charge generation layer include alcohol solvents, sulfoxide solvents, ketone solvents, ether solvents, ester solvents, aromatic hydrocarbon solvents, and the like.

The thickness of the charge generation layer is preferably from 0.01 μm to 5 μm and more preferably from 0.1 μm to 2 μm.

If required, a sensitizer, an antioxidant, an ultraviolet absorber, a plasticizer, and the like can be added to the charge generation layer.

In addition, the charge transport layer is formed on the charge generation layer. The charge transport layer can be formed by applying a coating solution for a charge transport layer prepared by dissolving a charge transport material and a binder resin in a solvent to form a film, and then drying the film.

Examples of the charge transport material used in the charge transport layer include triarylamine compounds, hydrazone compounds, styryl compounds, stilbene compounds, butadiene compounds, and the like. These charge transport materials may be used alone or in combination of two or more. Among these charge transport materials, triarylamine compounds are preferred from the viewpoint of charge mobility.

In the case of a laminated-type photosensitive layer, examples of the binder resin used in the charge transport layer include acrylic resins, acrylonitrile resins, allyl resins, alkyd resins, epoxy resins, silicone resins, phenol resins, phenoxy resins, polyacrylamide resins, polyamide-imide resins, polyamide resins, polyallyl ether resins, polyarylate resins, polyimide resins, polyurethane resins, polyester resins, polyethylene resins, polycarbonate resins, polysulfone resins, polyphenylene oxide resins, polybutadiene resins, polypropylene resins, methacryl resins, and the like. Among these, polyarylate resins and polycarbonate resins are preferred. These resins may be used alone or in combination as a mixture or copolymer of two or more.

Examples of the solvent used in the coating solution for a charge transport layer include alcohol solvents, sulfoxide solvents, ketone solvents, ether solvents, ester solvents, aromatic hydrocarbon solvents, and the like.

With respect to the ratio of the charge transport material to the binder resin in the charge transport layer, the ratio of the charge transport material is preferably from 0.3 parts by mass to 10 parts by mass per part by mass of the binder resin.

The drying temperature is preferably from 60° C. to 150° C. and more preferably from 80° C. to 120° C. from the viewpoint of suppressing cracking in the charge transport layer. Also, the drying time is preferably from 10 minutes to 60 minutes.

When the charge transport layer is a single layer, the thickness of the charge transport layer is preferably from 5 μm to 40 μm and more preferably from 8 μm to 30 μm. When the charge transport layer has a laminated structure, the thickness of the charge transport layer on the support side is preferably from 5 μm to 30 μm, and the thickness of the charge transport layer on the surface side is preferably from 1 μm to 10 μm.

If required, an antioxidant, an ultraviolet absorber, a plasticizer, and the like can be added to the charge transport layer.

Also, in the present invention, a protective layer may be provided on the charge transport layer for the purpose of improving abrasion resistance and cleaning properties.

The protective layer can be formed by applying a coating solution for a protective layer prepared by dissolving a binder resin in an organic solvent to form a film, and then drying the film.

Examples of the resin used in the protective layer include polyvinylbutyral resins, polyester resins, polycarbonate resins, polyamide resins, polyimide resins, polyarylate resins, polyurethane resins, styrene-butadiene copolymers, styrene-acrylic acid copolymers, styrene-acrylonitrile copolymers, and the like.

Also, in order to impart a charge transport ability to the protective layer, the protective layer may be formed by curing a monomer material having a charge transport ability or a polymer-type charge transport material using any one of various cross-linking reactions. The protective layer is preferably formed by curing a charge transporting compound having a chain-polymerizable functional group through polymerization or cross-linking.

Examples of the chain-polymerizable functional group include an acryl group, a methacryl group, an alkoxysilyl group, an epoxy group, and the like. A curing reaction is, for example, radial polymerization, ionic polymerization, thermal polymerization, optical polymerization, radiation polymerization (electron beam polymerization), a plasma CVD method, a light CVD method, or the like.

If required, the protective layer can further contain conductive particles, an ultraviolet absorber, an abrasion resistance-improving agent, and the like. The conductive particles are preferably metal oxide particles such as tin oxide particles or the like. The abrasion resistance-improving agent is, for example, fluorine atom-containing resin particles such as polytetrafluoroethylene particles or the like, alumina, silica, or the like.

The coating solution for each of the layers can be applied by using a coating method such as a dip coating method, a spray coating method, a spinner coating method, a roller coating method, a Meyer bar coating method, a blade coating method, or the like.

The thickness of the protective layer is preferably from 0.5 μm to 20 μm and more preferably from 1 μm to 10 μm.

<Electrophotographic Apparatus>

Figure 1:
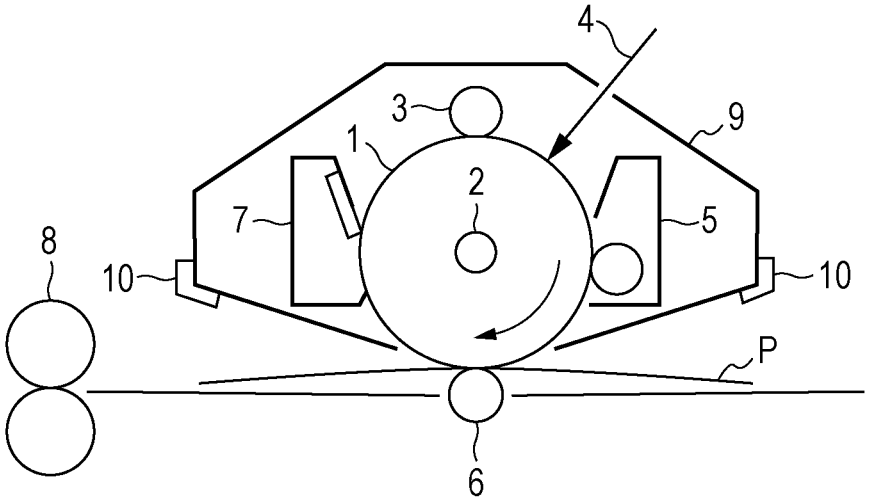
FIG. 1 is a drawing showing an example of a schematic configuration of an electrophotographic apparatus provided with a process cartridge including an electrophotographic photosensitive member of the present invention.

FIG. 1 shows a schematic configuration of an electrophotographic apparatus provided with a process cartridge including the electrophotographic photosensitive member of the present invention.

In FIG. 1, a drum-shaped electrophotographic photosensitive member 1 of the present invention is rotatively driven at a predetermined peripheral speed (process speed) around an axis 2 in a direction of an arrow. The surface of the electrophotographic photosensitive member 1 is charged to a predetermined positive or negative potential by a charging unit 3 (primary charging unit: charging roller) in a rotation process. Next, the electrophotographic photosensitive member 1 receives exposure light 4 which is light reflected from an original and output from an exposure unit (not shown) of slit exposure or laser beam scanning exposure with an intensity modulated in response to a time-series electric digital image signal of target image information. As a result, an electrostatic latent image corresponding to the target image information is sequentially formed on the surface of the electrophotographic photosensitive member 1.

The electrostatic latent image formed on the surface of the electrophotographic photosensitive member 1 is then developed by normal development or reverse development with a toner contained in a developer in a development unit 5 to form a toner image. Next, the toner image formed and held on the surface of the electrophotographic photosensitive member 1 is sequentially transferred to a transfer material P by transfer bias applied from a transfer unit 6 (transfer roller or the like).

In this case, the transfer material P is taken out from a transfer material feed unit (not shown) synchronously with the rotation of the electrophotographic photosensitive member 1 and is fed to a contact portion between the electrophotographic photosensitive member 1 and the transfer unit 6. In addition, a bias voltage with a polarity reverse to the charge possessed by the toner is applied to the transfer unit 6 from a bias power supply (not shown).

The transfer material P (final transfer material (paper or a film)) to which the toner image has been transferred is separated from the surface of electrophotographic photosensitive member 1, delivered to a fixing unit 8 in which the toner image is fixed, and then printed out as an image-formed substance (print or copy) to the outside of the electrophotographic apparatus. When the transfer material P is an intermediate transfer material, an image is printed out by fixing after multiple transfer steps.

After the toner image has been transferred, the surface of the electrophotographic photosensitive member 1 is cleaned by a cleaning unit 7 (cleaning blade or the like) to remove adhering materials such as the transfer residual developer (transfer residual toner).

In recent years, a cleaner-less system has been investigated, and the transfer residual toner can be directly recovered by a development unit. Further, the surface of the electrophotographic photosensitive member 1 is destaticized with pre-exposure light (not shown) from a pre-exposure unit (not shown) and then repeatedly used for image formation. As shown in FIG. 1, when the charging unit 3 is a contact charging unit using a charging roller, pre-exposure is not necessarily required.

In the present invention, a plurality of components selected from the electrophotographic photosensitive member 1, the charging unit 3, the development unit 5, and the cleaning unit 7 may be held in a container and integrally combined as a process cartridge.

The process cartridge may be configured to be detachable from the electrophotographic apparatus body of a copying machine, a laser beam printer, or the like. For example, the electrophotographic photosensitive member 1 and at least one of the charging unit 3, the development unit 5, and the cleaning unit 7 are integrally supported in a cartridge. The cartridge can be used as a process cartridge 9 which is detachable from the electrophotographic apparatus body using a guide unit 10 such as a rail or the like of the electrophotographic apparatus body.

When the electrophotographic apparatus is a copying machine or a printer, the exposure light 4 is reflected light or transmitted light from an original. Alternatively, the exposure light 4 is light irradiated by laser beam scanning, LED array driving, or liquid crystal shutter array driving performed according to a signal obtained by reading an original with a sensor.

The electrophotographic photosensitive member of the present invention can be applied to not only the electrophotographic apparatus, but also general electrophotographic apparatuses such as a laser beam printer, a LED printer, FAX, a liquid crystal shutter-type printer, etc.

EXAMPLES

The present invention is descried in further detail below by giving examples. However, the present invention is not limited to these examples. Further, "parts" described below represents "parts by mass".

[Production Example of Titanium Oxide Coated with Aluminum-Doped Tin Oxide]

Titanium oxide particles coated with tin oxide doped with aluminum can be produced as follows. The type and amount of a doping element and the amount of sodium stannate were changed according to examples.

First, 200 g of titanium oxide particles (average primary particle diameter 200 nm) was dispersed in water. Then, 208 g of sodium stannate ($Na_2SnO_3$) with a tin content of 41% wad added to the resultant dispersion and dissolved to prepare a mixed slurry. Then, tin was neutralized by adding a 20% aqueous diluted sulfuric acid solution (mass basis) while circulating the mixed slurry. The aqueous diluted sulfuric acid solution was added until the mixed slurry became pH 2.5. After neutralization, aluminum chloride (8 mol % based on Sn) was added to the mixed slurry, and the mixed slurry was stirred. As a result, a precursor of intended particles was obtained. The precursor was washed with hot water and subjected to dehydration filtration to produce a solid. The resultant solid was reduction-fired at 500° C. for 1 hour in a 2 volume % $H_2/N_2$ atmosphere. As a result, target conductive particles were produced. The doping amount of aluminum was 1.7% by mass.

The doping amount (% by mass) of aluminum in tin oxide can be measured by, for example, using a wavelength-dispersive fluorescence X-ray spectrometer (trade name; Axios) manufactured by Spectris Co., Ltd. A photosensitive layer and, if required, an undercoat layer are separated from an electrophotographic photosensitive member, the undercoat layer is scraped off, and the scraped-off undercoat layer can be used as a measuring object. Also, a powder of the same material as the undercoat layer can be used as a measuring object.

The doping amount of aluminum is a value calculated from the mass of alumina ($Al_2O_3$) based on the mass of tin oxide.

[Production Example of Particles Coated with Zinc-Doped Tin Oxide]

Titanium oxide particles coated with tin oxide doped with zinc can be produced as follows. The type and amount of a doping element and the amount of sodium stannate were changed according to examples.

First, 200 g of titanium oxide particles (average primary particle diameter 200 nm) was dispersed in water. Then, 208 g of sodium stannate ($Na_2SnO_3$) with a tin content of 41% was added to the resultant dispersion and dissolved to prepare a mixed slurry. Then, tin was neutralized by adding a 20% aqueous diluted sulfuric acid solution (mass basis) while circulating the mixed slurry. The aqueous diluted sulfuric acid solution was added until the mixed slurry became pH 2.5. After neutralization, zinc(II) chloride (1 mol % based on Sn) was added to the mixed slurry, and the mixed slurry was stirred. As a result, a precursor of intended conductive particles was obtained. The precursor was washed with hot water and subjected to dehydration filtration to produce a solid. The resultant solid was reduced and fired at 500° C. for 1 hour in a 2 volume % $H_2/N_2$ atmosphere. As a result, target conductive particles were produced. The ratio by as of zinc doped into tin oxide was 1.7% by mass.

The doping amount (% by mass) of zinc in tin oxide can be measured by, for example, using a wavelength-dispersive fluorescence X-ray spectrometer (trade name; Axios) manufactured by Spectris Co., Ltd. A photosensitive layer and, if required, an undercoat layer are separated from an electrophotographic photosensitive member, the undercoat layer is scraped off, and the scraped-off undercoat layer can be used as a measuring object. Also, a powder of the same material as the undercoat layer can be used as a measuring object.

The doping amount of zinc is a value calculated from the mass of zinc chloride based on the mass of tin oxide.

Example 1

An aluminum cylinder (conductive support) having a diameter of 30 mm and a length of 357.5 mm was used as a support.

Next, 100 parts of zinc oxide particles (specific surface area: 15 $m^2/g$, powder resistance: $3.7\times10^5$ Ω·cm) was mixed with 500 parts of toluene by stirring. Then, 1.5 parts of N-(2-aminoethyl)-3-aminopropyl trimethoxysilane (trade name: KBM603, manufactured by Shin-Etsu Chemical Co., Ltd.) serving as a silane coupling agent was added to the resultant mixture and stirred for 6 hours. Then, toluene was distilled off under reduced pressure, and the residue was dried by heating at 140° C. for 6 hours to produce surface-treated zinc oxide particles.

Next, 15 parts of butyral resin as a polyol resin (trade name: BM-1, manufactured by Sekisui Chemical Co., Ltd.) and 15 parts of blocked isocyanate (trade name: Desmodur BL3175/1, manufactured by Sumika Bayer Urethane Co., Ltd.) were dissolved in a mixed solvent containing 73.5 parts of methyl ethyl ketone and 73.5 parts of 1-butanol. Then, 78 parts of the surface-treated zinc oxide particles, 9 parts of titanium oxide coated with aluminum-doped tin oxide (powder resistivity: $1\times10^5$ Ω·cm, $SnO_2$ coating rate: 40%), 0.8 parts of alizarin (manufactured by Tokyo Chemical Industry Co., Ltd.), and 0.81 parts of zinc octylate (trade name: Nikka Octycs zinc, Zn 8%, manufactured by Nihon Kagaku Sangyo Co., Ltd.) were added to the resultant solution, and then the resultant mixture was dispersed in a sand mill using glass beads having a diameter of 0.8 mm for 3 hours in an environment of 23±3° C.

After dispersion, 0.01 parts of silicone oil (trade name: SH28PA, manufactured by Dow Corning Toray Silicone Co., Ltd.) and 5.6 parts of silicone resin particles (trade name: Tospearl 145, manufactured by GE Toshiba Silicone Co., Ltd.) were added to the resultant dispersion solution and stirred to form a coating solution for an undercoat layer.

Next, the coating solution for an undercoat layer was applied to the support by dip coating to form a film. The resultant film was dried at 150° C. for 30 minutes to form an undercoat layer having a thickness of 20 μm.

Next, hydroxygallium phthalocyanine crystal (charge generation material) having a crystal form having peaks at Bragg angles 2θ±0.2° of 7.4° and 28.1° in CuKα characteristic X-ray diffraction was prepared.

Then, 4 parts of hydroxygallium phthalocyanine crystal and 0.04 parts of a compound represented by formula (A) below were added to a solution prepared by dissolving 2 parts of polyvinyl butyral resin (trade name: S-Lec BX-1, manufactured by Sekisui Chemical Co., Ltd.) in 100 parts of cyclohexanone. The resultant mixture was dispersed in a sand mill using glass beads having a diameter of 1 mm for 1 hour in an environment at 23±3° C. After dispersion, 100 parts of ethyl acetate was added to the resultant dispersion solution to prepare a coating solution for a charge generation layer. The coating solution for a charge generation layer was applied to the undercoat layer by dip coating to form a film, and the resultant film was dried at 90° C. for 10 minutes to form a charge generation layer having a thickness of 0.20 μm.

(A)

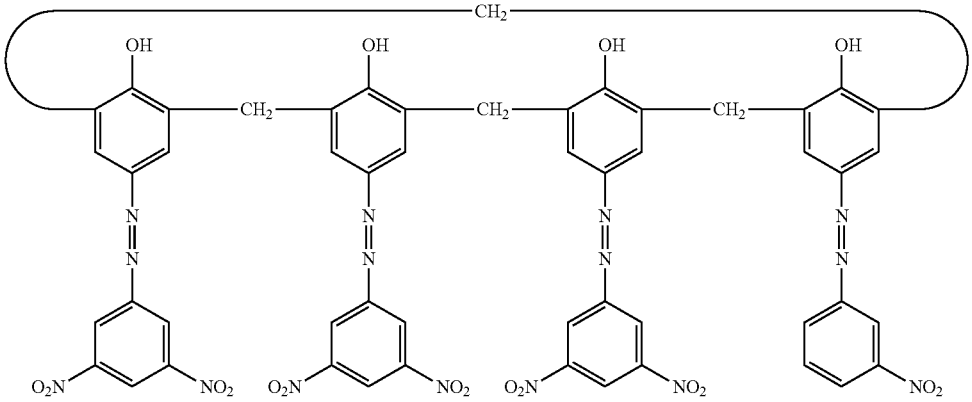

Next, 50 parts of an amine compound (charge transport material) represented by formula (B) below, 50 parts of an amine compound (charge transport material) represented by formula (C) below, and 100 parts of polycarbonate resin (trade name: Iupilon 2400, manufactured by Mitsubishi Gas Chemical Company Inc.) were dissolved in a mixed solvent containing 650 parts of chlorobenzene and 150 parts of dimethoxymethane to prepare a coating solution for a charge transport layer. The resultant coating solution for a charge transport layer was allowed to stand for 1 day and then applied to the charge generation layer by dip coating to for a film, and the resultant film was dried at 110° C. for 30 minutes to form a charge transport layer having a thickness of 21 μm.

(B)

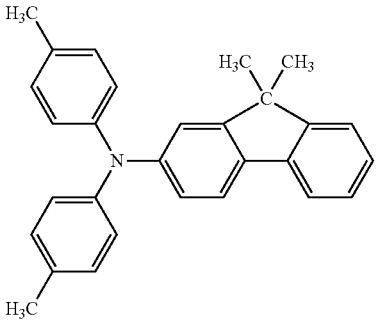

(C)

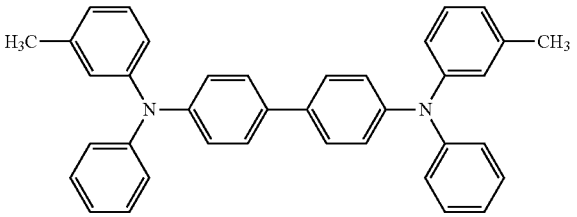

Next, 36 parts of a compound (D) represented by a formula below and 4 parts of polytetrafluoroethylene resin particles (trade name: Ruburon L-2, manufactured by Daikin Industries, Ltd) were mixed with 60 parts of n-propyl alcohol, and the resultant mixture was dispersed in a high-pressure disperser to prepare a coating solution for a protective layer.

(D)

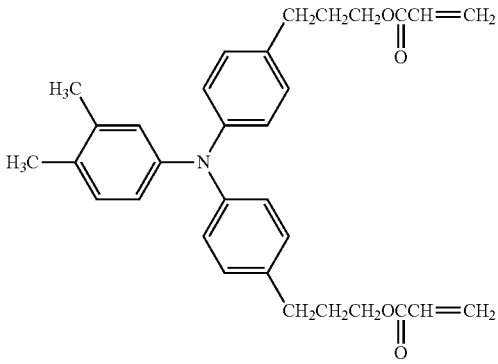

The coating solution for a protective layer was applied to the charge transport layer by dip coating to form a film, and the film was dried at 50° C. for 5 minutes. After drying, the film was irradiated with an electron beam while the support was rotated in a nitrogen atmosphere under the conditions including an acceleration voltage of 70 kV and an amount of absorbed light of 8000 Gy for 1.6 seconds. Then, the film was heated in a nitrogen atmosphere for 3 minutes under conditions in which the film was at 130° C. In addition, the oxygen concentration from irradiation with the electron beam to heating for 3 minutes was 20 ppm. Next, the film was heated in the air for 30 minutes under conditions in which the film was at 100° C. to form a protective layer having a thickness of 5 μm.

Consequently, an electrophotographic photosensitive member was produced, in which the undercoat layer, the charge generation layer, the charge transport layer, and the protective layer were provided on the support. Next, evaluation is described.

<Evaluation of a Change in Light-Area Potential During Repeated Use>

An electrophotographic copying machine manufactured by Canon Kabushiki Kaisha (trade name: GP405, modified so that a process speed was 300 mm/s, and a charging unit was of a type of applying a voltage in which an AC voltage was superimposed on a DC voltage to a roller-type contact charging member (charging roller)) was used as an evaluation apparatus. The electrophotographic photosensitive member described above was provided on a drum cartridge of the evaluation apparatus and evaluated as described below.

The evaluation apparatus was installed in an environment at room temperature and normal humidity of temperature 23° C./humidity 50% RH and an environment at high temperature and high humidity of temperature 30° C./humidity 85% RH. Charging conditions included a peak-to-peak voltage of 1500 V in an AC component of the voltage applied to the charging roller, a frequency of 1500 Hz, and a DC component of −850 V. Exposure conditions were adjusted to be 0.4 $\mu J/cm^2$.

The surface potential of the electrophotographic photosensitive member was measured by fixing a potential probe (trade name: Model 16000 B-8, manufactured by Trek Inc.) to a development cartridge removed from the evaluation apparatus and using a surface potentiometer (trade name, Model 1344, manufactured by Trek Inc.). In a potential measuring apparatus, the potential measuring probe was placed at a development position of the development cartridge. The position of the potential measuring probe relative to the electrophotographic photosensitive member was located at a center in the axial direction of the electrophotographic photosensitive member and separated at a gap of 3 mm from the surface of the electrophotographic photosensitive member.

Next, evaluation is described. The evaluation was performed under the charging conditions and exposure conditions initially set for each electrophotographic photosensitive member.

The electrophotographic photosensitive member was allowed to stand in an environment at a temperature of 23° C. and a humidity of 50% RH for 24 hours. Then, the development cartridge to which the electrophotographic photosensitive member was attached was provided on the evaluation apparatus in which the electrophotographic photosensitive member was repeatedly used by feeding 50,000 sheets of paper. The initial light-area potential (VIJa) was measured before the electrophotographic photosensitive member was repeatedly used by feeding 50,000 sheets of paper.

After 50000 sheets had been fed, the electrophotographic photosensitive member was allowed to stand for 5 minutes, and then the development cartridge was replaced with a potential measurement device and the light-area potential (VIJb) after feeding of 50000 sheets was measured. In addition, a change in light-area potential ($\Delta VIJ=|VIJb|-|VIJa|$) in repeated use was calculated.

In this case, VIJa was the initial light-area potential before repeated use. In addition, |VIJb| and |VIJa| represent absolute values of VIJb and VIJa, respectively.

<Evaluation of Defect Concealing Property of Support>

A method for evaluating the defect concealing property of the support was to measure transmittance of the undercoat layer formed in a thickness of 20 μm on a transparent film. The transmittance was measured by providing a film holder on V-570 (manufactured by JASCO) and an uncoated transparent film as a reference. The transmittance was determined by using light at a wavelength of 800 nm and classified into ranks below.

Rank 1: Transmittance of 0.5% or less

Rank 2: Transmittance of more than 0.5% and less than 0.8%

Rank 3: Transmittance of 0.8% or more

<Evaluation of Black Dots>

Black dots were evaluated by forming an electrophotographic photosensitive member having a charge transport layer having a thickness of 10 μm and outputting a half-tone image using the GP405 modified machine described above. The output results of the half-tone image were classified into ranks below. The ranks 1 to 3 were considered as a level at which the effect of the present invention was exhibited.

Rank 1: 1 black dot within a range corresponding to the circumferential length of the photosensitive member.

Rank 2: 2 black dots within a range corresponding to the circumferential length of the photosensitive member.

Rank 3: 3 black dots within a range corresponding to the circumferential length of the photosensitive member.

Rank 4: 4 black dots within a range corresponding to the circumferential length of the photosensitive member.

Rank 5: 5 black dots within a range corresponding to the circumferential length of the photosensitive member.

Comparative Example 1

An electrophotographic photosensitive member was formed and evaluated by the same method as in Example 1 except that the titanium oxide particles coated with aluminum-doped tin oxide of Example 1 were not contained.

Comparative Example 2

An electrophotographic photosensitive member was formed and evaluated by the same method as in Example 1 except that the amount of the titanium oxide particles coated with aluminum-doped tin oxide of Example 1 was changed to 2.1 parts.

Comparative Example 3

An electrophotographic photosensitive member was formed and evaluated by the same method as in Example 1 except that in Example 1, the amount of the surface-treated zinc oxide particles was changed to 105 parts, and the amount of the titanium oxide particles coated with aluminum-doped tin oxide was changed to 2.4 parts.

Comparative Example 4

An electrophotographic photosensitive member was formed and evaluated by the same method as in Example 1 except that the amount of the titanium oxide particles coated with aluminum-doped tin oxide of Example 1 was changed to 33 parts.

Example 2

An electrophotographic photosensitive member was formed and evaluated by the same method as in Example 1 except that the titanium oxide particles coated with aluminum-doped tin oxide of Example 1 was changed to 15 parts of titanium oxide particles coated with oxygen-deficient tin oxide (powder resistivity: $1\times10^2$ Ω·cm, $SnO_2$ coating rate: 40%).

Example 3

An electrophotographic photosensitive member was formed and evaluated by the same method as in Example 1 except that the titanium oxide particles coated with aluminum-doped tin oxide of Example 1 was changed to 15 parts of titanium oxide particles coated with oxygen-deficient tin oxide (powder resistivity: $1\times10^9$ Ω·cm, $SnO_2$ coating rate: 40%).

Example 4

An electrophotographic photosensitive member was formed and evaluated by the same method as in Example 1E except that the titanium oxide particles coated with aluminum-doped tin oxide of Example 1 was changed to 15 parts of titanium oxide particles coated with fluorine-doped tin oxide (powder resistivity: $1\times10^5$ Ω·cm, $SnO_2$ coating rate: 40%).

Comparative Example 5

An electrophotographic photosensitive member was formed and evaluated by the same method as in Example 1 except that in Example 1, the amount of zinc oxide particles was changed to 105 parts and the titanium oxide particles coated with aluminum-doped tin oxide was changed to 36 parts of titanium oxide particles coated with fluorine-doped tin oxide (powder resistivity: $1\times10^2$ Ω·cm, $SnO_2$ coating rate: 40%).

Comparative Example 6

An electrophotographic photosensitive member was formed and evaluated by the same method as in Example 1 except that in Example 1, the amount of zinc oxide particles was changed to 60 parts and the titanium oxide particles coated with aluminum-doped tin oxide was changed to 3 parts of titanium oxide particles coated with fluorine-doped tin oxide (powder resistivity: $1\times10^6$ Ω·cm, $SnO_2$ coating rate: 40%).

Example 5

An electrophotographic photosensitive member was formed and evaluated by the same method as in Example 1 except that in Example 1, the amount of zinc oxide particles was changed to 81 parts and the titanium oxide particles coated with aluminum-doped tin oxide was changed to 15 parts of titanium oxide particles coated with tungsten-doped tin oxide (powder resistivity: $1\times10^5$ Ω·cm, $SnO_2$ coating rate: 40%).

Example 6

An electrophotographic photosensitive member was formed and evaluated by the same method as in Example 1 except that in Example 1, the amount of zinc oxide particles was changed to 78 parts and the titanium oxide particles coated with aluminum-doped tin oxide was changed to 12 parts of titanium oxide particles coated with niobium-doped tin oxide (powder resistivity: $1\times10^4$ Ω·cm, $SnO_2$ coating rate: 40%).

Example 7

An electrophotographic photosensitive member was formed and evaluated by the same method as in Example 1 except that in Example 1, the amount of zinc oxide particles was changed to 90 parts and the titanium oxide particles coated with aluminum-doped tin oxide was changed to 12 parts of titanium oxide particles coated with tantalum-doped tin oxide (powder resistivity: $1\times10^4$ Ω·cm, $SnO_2$ coating rate: 40%).

Example 8

An electrophotographic photosensitive member was formed and evaluated by the same method as in Example 1 except that in Example 1, the amount of zinc oxide particles was changed to 75 parts and the titanium oxide particles coated with aluminum-doped tin oxide was changed to 15 parts of titanium oxide particles coated with phosphorus-doped tin oxide (powder resistivity: $1\times10^3$ Ω·cm, $SnO_2$ coating rate: 40%).

Example 9

An electrophotographic photosensitive member was formed and evaluated by the same method as in Example 1 except that in Example 1, the amount of zinc oxide particles was changed to 78 parts and the titanium oxide particles coated with aluminum-doped tin oxide was changed to 9 parts of titanium oxide particles coated with zinc-doped tin oxide (powder resistivity: $1\times10^7$ Ω·cm, $SnO_2$ coating rate: 40%).

Example 10

An electrophotographic photosensitive member was formed and evaluated by the same method as in Example 1 except that the amount of titanium oxide particles coated with aluminum-doped tin oxide of Example 1 was changed to 15.6 parts.

Example 11

An electrophotographic photosensitive member was formed and evaluated by the same method as in Example 1 except that in Example 1, the amount of zinc oxide particles was changed to 90 parts and the amount of titanium oxide particles coated with aluminum-doped tin oxide was changed to 15 parts.

Example 12

An electrophotographic photosensitive member was formed and evaluated by the same method as in Example 1 except that in Example 1, the amount of zinc oxide particles was changed to 75 parts and the titanium oxide particles coated with aluminum-doped tin oxide was changed to 15 parts of titanium oxide particles coated with oxygen-deficient tin oxide (powder resistivity: $1\times10^5$ Ω·cm, $SnO_2$ coating rate: 40%).

Comparative Example 7

An electrophotographic photosensitive member was formed and evaluated by the same method as in Example 1 except that in Example 1, the amount of zinc oxide particles was changed to 75 parts and the titanium oxide particles coated with aluminum-doped tin oxide was changed to 15 parts of titanium oxide particles coated with antimony-doped tin oxide (powder resistivity: $1\times10^5$ Ω·cm, $SnO_2$ coating rate: 40%).

Example 13

An electrophotographic photosensitive member was formed and evaluated by the same method as in Example 1 except that the undercoat layer of Example 1 was changed as described below.

First, 100 parts of zinc oxide particles (specific surface area: 19 $m^2/g$, powder resistance: $1.0\times10^8$ Ω·cm) was mixed with 500 parts of toluene under stirring. Then, 1.0 part of a silane coupling agent (surface treatment agent) was added to the resultant mixture and mixed under stirring for 6 hours. Then, toluene was distilled off under reduced pressure, and the residue was dried at 140° C. for 6 hours to produce zinc oxide particles surface-treated with the silane coupling agent. In this example, N-(2-aminoethyl)-3-aminopropylmethyl dimethoxysilane (trade name: KBM602 manufactured by Shin-Etsu Chemical Co., Ltd.) was used as the silane coupling agent.

Next, 15 parts of butyral resin as a polyol resin (trade name: BM-1, manufactured by Sekisui Chemical Co., Ltd.) and 15 parts of blocked isocyanate resin (trade name: TPA-B80E, 80% solution, manufactured by Asahi Kasei Kogyo Co., Ltd.) were dissolved in a mixed solvent containing 73.5 parts of methyl ethyl ketone and 73.5 parts of cyclohexanone to prepare a solution.

Then, 78 parts of the zinc oxide particles surface-treated with the silane coupling agent described above, 9 parts of titanium oxide coated with aluminum-doped tin oxide (powder resistivity: $1\times10^8$ Ω·cm, $SnO_2$ coating rate: 35%), and 0.8 parts of 2,3,4-trihydroxybenzophenone (manufactured by Tokyo Chemical Industry Co., Ltd.)

were added to the resultant solution, and then the resultant mixture was dispersed in a vertical sand mill using 180 parts of glass beads having an average particle diameter of 1.0 mm as a dispersion medium in an environment of 23±3° C. under the condition of a rotational speed of 1500 rpm (peripheral speed 5.5 m/s) for 4 hours.

After dispersion, 0.01 parts of silicone oil (trade name: SH28PA, manufactured by Dow Corning Toray Silicone Co., Ltd.) and 5.6 parts of cross-linked polymethyl methacrylate (PMMA) particles (trade name: TECHPOLYMER SSX-102, manufactured by Sekisui Kasei Kogyo Co., Ltd., primary average particle diameter: 2.5 μm) were added to the resultant dispersion solution and stirred to prepare a coating solution for an undercoat layer.

The resultant coating solution for an undercoat layer was applied to an aluminum cylinder by dip coating to form a film. The film was dried by heating at 170° C. for 30 minutes to form an undercoat layer having a thickness of 30 μm.

Example 14

An electrophotographic photosensitive member was formed and evaluated by the same method as in Example 13 except that the titanium oxide coated with aluminum-doped tin oxide of Example 13 was changed to titanium oxide coated with zinc-doped tin oxide (powder resistivity: $1\times10^5$ Ω·cm, $SnO_2$ coating rate: 35%).

Example 15

An electrophotographic photosensitive member was formed and evaluated by the same method as in Example 14 except that the titanium oxide coated with zinc-doped tin oxide (powder resistivity: $1\times10^5$ Ω·cm, $SnO_2$ coating rate: 35%) of Example 14 was changed to titanium oxide coated with zinc-doped tin oxide (powder resistivity: $1\times10^3$ Ω·cm, $SnO_2$ coating rate: 20%).

TABLE 1

| | Dopant type in (B) | Doping amount in (B) (% by mass) | Powder resistance of (B) (Ω · cm) | (A)/(B) | Content based on (A) (% by mass) | Film resistance (Ω · cm) |
|---|---|---|---|---|---|---|
| Example 1 | Aluminum | 0.50% | $1.0 \times 10^5$ | 78/9 | 11.5% | $1.0 \times 10^{13}$ |
| Comparative Example 1 | — | — | — | 78/0 | 0.0% | $1.0 \times 10^{13}$ |
| Comparative Example 2 | Aluminum | 0.50% | $1.0 \times 10^5$ | 78/2.1 | 2.7% | $9.8 \times 10^{12}$ |
| Comparative Example 3 | Aluminum | 0.50% | $1.0 \times 10^5$ | 105/2.4 | 2.3% | $1.0 \times 10^{13}$ |
| Comparative Example 4 | Aluminum | 0.50% | $1.0 \times 10^5$ | 78/33 | 42.3% | $1.0 \times 10^{13}$ |
| Example 2 | (Oxygen deficient) | — | $1.0 \times 10^2$ | 78/15 | 19.2% | $7.0 \times 10^{12}$ |
| Example 3 | (Oxygen deficient) | — | $1.0 \times 10^9$ | 78/15 | 19.2% | $1.0 \times 10^{13}$ |
| Example 4 | Fluorine | 1% | $1.0 \times 10^5$ | 78/15 | 19.2% | $1.0 \times 10^{12}$ |
| Comparative Example 5 | Fluorine | 10% | $1.0 \times 10^2$ | 105/36 | 34.3% | $1.0 \times 10^9$ |
| Comparative Example 6 | Fluorine | 0.50% | $1.0 \times 10^6$ | 60/3 | 5.0% | $1.0 \times 10^{14}$ |
| Example 5 | Tungsten | 1% | $1.0 \times 10^5$ | 81/15 | 18.5% | $1.0 \times 10^{12}$ |
| Example 6 | Niobium | 2% | $1.0 \times 10^4$ | 78/12 | 15.4% | $5.0 \times 10^{11}$ |
| Example 7 | Tantalum | 3% | $1.0 \times 10^4$ | 90/12 | 13.3% | $1.0 \times 10^{10}$ |
| Example 8 | Phosphorus | 2% | $1.0 \times 10^3$ | 75/15 | 20.0% | $1.0 \times 10^{12}$ |
| Example 9 | Zinc | 3% | $1.0 \times 10^7$ | 78/9 | 11.5% | $5.0 \times 10^{12}$ |
| Example 10 | Aluminum | 0.50% | $1.0 \times 10^8$ | 78/15.6 | 20.0% | $1.0 \times 10^{13}$ |
| Example 11 | Aluminum | 0.50% | $1.0 \times 10^8$ | 90/15 | 16.7% | $1.0 \times 10^{11}$ |
| Example 12 | (Oxygen deficient) | — | $1.0 \times 10^5$ | 75/15 | 20.0% | $5.0 \times 10^{11}$ |
| Comparative Example 7 | Antimony | 0.50% | $1.0 \times 10^5$ | 75/15 | 20.0% | $5.0 \times 10^{12}$ |
| Example 13 | Aluminum | 1.70% | $1.0 \times 10^8$ | 78/9 | 11.5% | $1.0 \times 10^{13}$ |
| Example 14 | Zinc | 2% | $1.0 \times 10^5$ | 78/9 | 11.5% | $1.0 \times 10^{13}$ |
| Example 15 | Zinc | 0.02% | $1.0 \times 10^3$ | 78/9 | 11.5% | $9.0 \times 10^{12}$ |

TABLE 2

| | Concealing property of support | Initial light-area potential VIJa(V) | Change in light-area potential ΔVIJ(V) | Black dot |
|---|---|---|---|---|
| Example 1 | 1 | −110 | 10 | 1 |
| Comparative Example 1 | 3 | −140 | 10 | 1 |
| Comparative Example 2 | 3 | −140 | 10 | 1 |
| Comparative Example 3 | 3 | −140 | 15 | 1 |
| Comparative Example 4 | 1 | −110 | 10 | 4 |
| Example 2 | 1 | −90 | 10 | 3 |
| Example 3 | 1 | −100 | 10 | 1 |

TABLE 2-continued

| | Concealing property of support | Initial light-area potential VIJa(V) | Change in light-area potential ΔVIJ(V) | Black dot |
|---|---|---|---|---|
| Example 4 | 1 | −115 | 10 | 2 |
| Comparative Example 5 | 1 | −110 | 10 | 4 |
| Comparative Example 6 | 3 | −140 | 50 | 1 |
| Example 5 | 1 | −110 | 10 | 2 |
| Example 6 | 1 | −110 | 10 | 2 |
| Example 7 | 1 | −110 | 10 | 2 |
| Example 8 | 1 | −120 | 5 | 2 |
| Example 9 | 1 | −100 | 10 | 1 |
| Example 10 | 1 | −110 | 10 | 1 |
| Example 11 | 1 | −100 | 10 | 1 |
| Example 12 | 1 | −100 | 5 | 2 |
| Comparative Example 7 | 1 | −90 | 5 | 5 |
| Example 13 | 1 | −120 | 15 | 1 |
| Example 14 | 1 | −105 | 5 | 1 |
| Example 15 | 1 | −95 | 10 | 1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-023705, filed Feb. 9, 2015, which is hereby incorporated by reference herein in its entirety.

What is claimed is:

1. An electrophotographic photosensitive member comprising:

an electrically conductive support;

an undercoat layer on the electrically conductive support; and a photosensitive layer on the undercoat layer, wherein the undercoat layer has a volume resistivity of from $1\times10^{10}$ Ω·cm to $1\times10^{13}$ Ω·cm;

the undercoat layer comprises:

(A) a zinc oxide particle; and (B) at least one particle selected from the group consisting of titanium oxide particles coated with tin oxide doped with any one of zinc, aluminum, fluorine, tungsten, niobium, tantalum, and phosphorus, and a titanium oxide particle coated with oxygen deficient tin oxide; and the content of the particle (B) in the undercoat layer is from 3% by mass to 20% by mass based on the content of the particle (A).

2. The electrophotographic photosensitive member according to claim 1, wherein the powder resistivity of the particle (B) is from $1\times10^{2}$ Ω·cm to $1\times10^{8}$ Ω·cm.

3. The electrophotographic photosensitive member according to claim 1, wherein the undercoat layer comprises a binder resin.

4. The electrophotographic photosensitive member according to claim 1, wherein a doping amount in the particle (B) is from 0.1% by mass to 10% by mass based on the mass of tin oxide in the particle (B).

5. The electrophotographic photosensitive member according to claim 1, wherein the particle (B) is a titanium oxide particle coated with tin oxide doped with aluminum.

6. The electrophotographic photosensitive member according to claim 1, wherein the particle (B) is a titanium oxide particle coated with oxygen-deficient tin oxide.

7. The electrophotographic photosensitive member according to claim 1, wherein the particle (B) is a titanium oxide particle coated with tin oxide doped with zinc.

8. A process cartridge comprising:

the electrophotographic photosensitive member according to claim 1; and at least one selected from the group consisting of a charging unit, a development unit, a transfer unit, and a cleaning unit, the electrophotographic photosensitive member and the at least one unit being integrally supported, and the process cartridge being detachable from an electrophotographic apparatus body.

9. An electrophotographic apparatus comprising the electrophotographic photosensitive member according to claim 1, a charging unit, an exposure unit, a development unit, and a transfer unit.

* * * * *